US009498006B2

(12) United States Patent
Holland

(10) Patent No.: US 9,498,006 B2
(45) Date of Patent: Nov. 22, 2016

(54) SLEEPING AID THAT RESTRICTS MOVEMENT DURING SLEEP

(71) Applicant: William Ward Holland, Atlanta, GA (US)

(72) Inventor: William Ward Holland, Atlanta, GA (US)

( * ) Notice: Subject to any disclaimer, the term of this patent is extended or adjusted under 35 U.S.C. 154(b) by 20 days.

(21) Appl. No.: 13/774,918

(22) Filed: Feb. 22, 2013

(65) Prior Publication Data

US 2014/0026294 A1 Jan. 30, 2014

Related U.S. Application Data

(60) Provisional application No. 61/675,781, filed on Jul. 25, 2012.

(51) Int. Cl.

| | |
|---|---|
| ***A41D 1/06*** | (2006.01) |
| ***A41D 10/00*** | (2006.01) |
| ***A41D 13/00*** | (2006.01) |
| *A41D 13/12* | (2006.01) |

(52) U.S. Cl.

CPC ..... *A41D 1/06* (2013.01); *A41D 10/00* (2013.01); *A41D 13/0012* (2013.01); *A41D 13/1254* (2013.01)

(58) Field of Classification Search

CPC ..... A41D 13/065; A41D 13/0593; A41D 10/00; A41D 1/06; A41D 1/08; A41D 13/0012

USPC ..... 2/23, 24, 83, 227, 228; 5/630

See application file for complete search history.

(56) References Cited

U.S. PATENT DOCUMENTS

| | | | | |
|---|---|---|---|---|
| 3,485,241 | A * | 12/1969 | Polley | 128/871 |
| 5,377,693 | A * | 1/1995 | Loper et al. | 128/845 |
| 6,327,713 | B1 * | 12/2001 | Gomez | A41D 10/00 2/227 |
| 6,357,444 | B1 * | 3/2002 | Parker | 128/848 |
| 6,532,599 | B1 * | 3/2003 | Dugan | 2/228 |
| 6,760,936 | B1 * | 7/2004 | Lloyd | 5/650 |
| 2006/0185055 | A1 * | 8/2006 | DeWitt | 2/111 |
| 2007/0044199 | A1 * | 3/2007 | Ebert | 2/111 |
| 2010/0006108 | A1 * | 1/2010 | Kerklaan | A61F 5/56 128/848 |

* cited by examiner

*Primary Examiner* — Katherine Moran

(74) *Attorney, Agent, or Firm* — Dunlap Bennett & Ludwig PLLC

(57) ABSTRACT

Motion limiting pants prevent a person from turning over onto his or her back or stomach while sleeping on his or her sides, or prevents a person from turning over onto his or her side while sleeping on his or her back or stomach. The motion limiting pants can include one or more pockets formed therein. The pockets can be filled with a filling material, such as a lightweight foam. The pockets can be formed either on the sides of the pants to prevent side sleeping, or on the front and back of the pants to prevent back and/or stomach sleeping.

9 Claims, 4 Drawing Sheets

SLEEPING AID THAT RESTRICTS MOVEMENT DURING SLEEP

CROSS-REFERENCE TO RELATED APPLICATION

This application claims the benefit of U.S. provisional application No. 61/675,781, filed Jul. 25, 2012, the contents of which are herein incorporated by reference.

BACKGROUND OF THE INVENTION

The present invention relates to garment and, more particularly, to a garment that prevents a person from turning over onto his/her back while sleeping.

Snoring and obstructive sleep apnea are common respiratory obstructive sleep disorders that can affect an individual's quality of sleep. Snoring and obstructive sleep apnea are usually exacerbated when people sleep on their backs. In addition, these respiratory disorders have been associated with cardiovascular diseases and an increased risk of stroke. People with heart disease should not sleep on their backs. Unfortunately, people tend to turn over onto their backs while sleeping.

Conventional sleep apnea aids are aligned with the sleeper's spine and allow substantial movement of the body before jolting the sleeper back on his or her side or stomach, preventing an undisturbed sleeping period.

As can be seen, there is a need for a device that prevents a person from turning over to an undesirable position, such as onto his or her back, while sleeping.

In one aspect of the present invention, motion limiting pants comprise at least a first pocket formed along at least one of the following: sides of the motion limiting pants, a front right thigh surface of the motion limiting pants, a front left thigh of surface of the motion limiting pants, a rear right thigh surface of the motion limiting pants, and a rear left thigh surface of the motion limiting pants; and at least a first filling material fitting into the at least first pocket, wherein the first filling material has a thickness from about 3 to about 5 inches and a length from about 6 to about 12 inches.

In another the present invention, motion limiting pants comprise at least a first and a second pocket formed along at least two of the following: sides of the motion limiting pants, a front right thigh surface of the motion limiting pants, a front left thigh of surface of the motion limiting pants, a rear right thigh surface of the motion limiting pants, and a rear left thigh surface of the motion limiting pants; and at least a first filling material and a second filling material fitting into the at least first pocket and second pocket, wherein the at least first and second pockets are either 1) disposed on the sides of the motion limiting pants, operable to prevent a user from rolling away from a back-sleeping position or a stomach-sleeping position; or 2) disposed on a front and a rear side of one leg of the motion limiting pants to prevent a user from rolling away from a side-sleep position.

In a further aspect of the present invention, a method for limiting motion of a sleeper comprises wearing motion limiting pants, the motion limiting pants having at least a first pocket formed along at least one of the following: sides of the motion limiting pants, a front right thigh surface of the motion limiting pants, a front left thigh of surface of the motion limiting pants, a rear right thigh surface of the motion limiting pants, and a rear left thigh surface of the motion limiting pants and at least a first filling material fitting into the at least first pocket, wherein the first filling material has a thickness from about 3 to about 5 inches and a length from about 6 to about 12 inches.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the claims.

Broadly, an embodiment of the present invention provides motion limiting pants that prevent a person from turning over onto his or her back or stomach while sleeping on his or her side, or prevents a person from turning over his or her side while sleeping on his or her back or stomach. The motion limiting pants can include one or more pockets formed therein. The pockets can be filled with a filling material, such as a lightweight foam. The pockets can be formed either on the sides of the pants to prevent side sleeping, or on the front and back of the pants to prevent back and/or stomach steeping.

Figure 1:
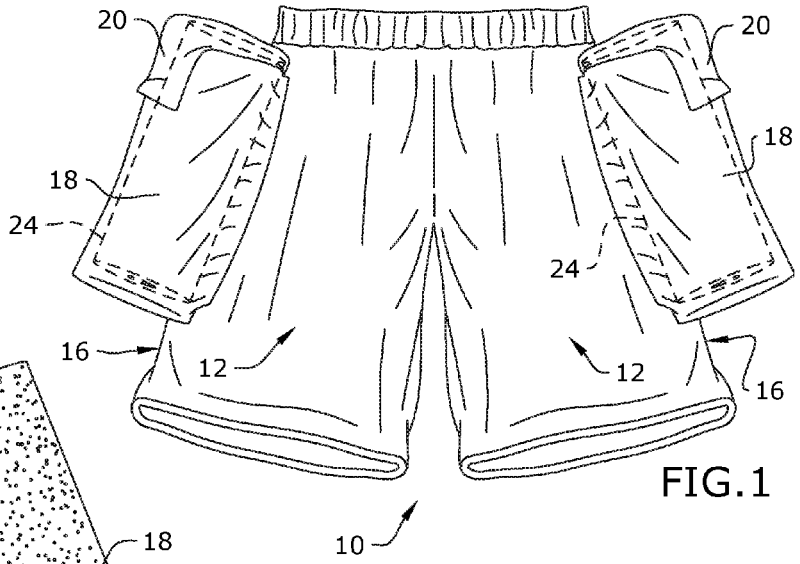
FIG. 1 is a front view of a sleep apnea sleeping aid according to an exemplary embodiment of the present invention.
Figure 2:
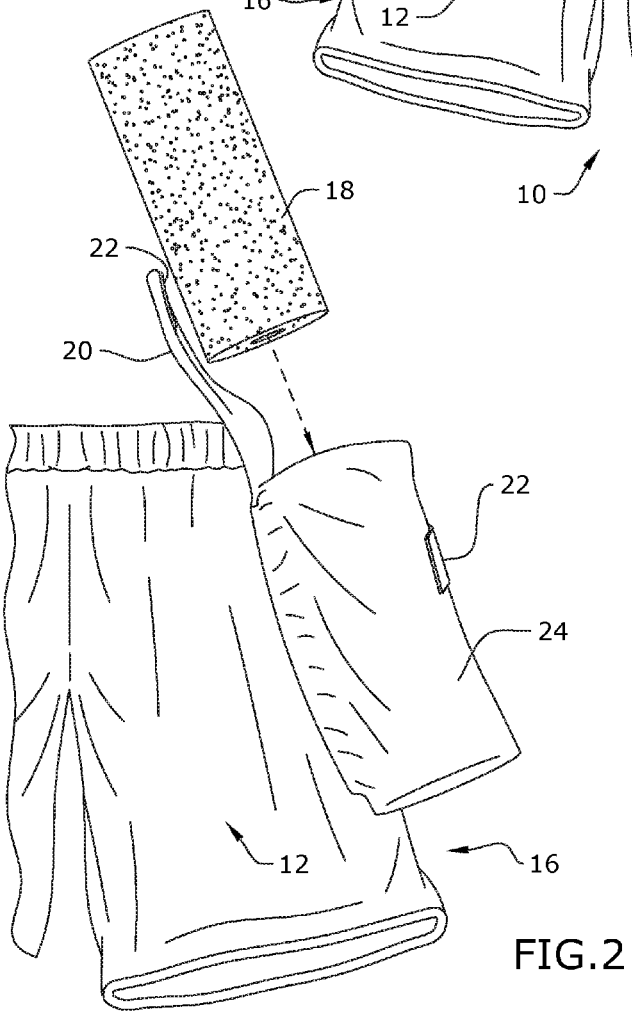
FIG. 2 is an exploded detailed perspective view of the sleep apnea sleeping aid of FIG. 1, illustrating a filler material removed from a pocket.
Figure 3:
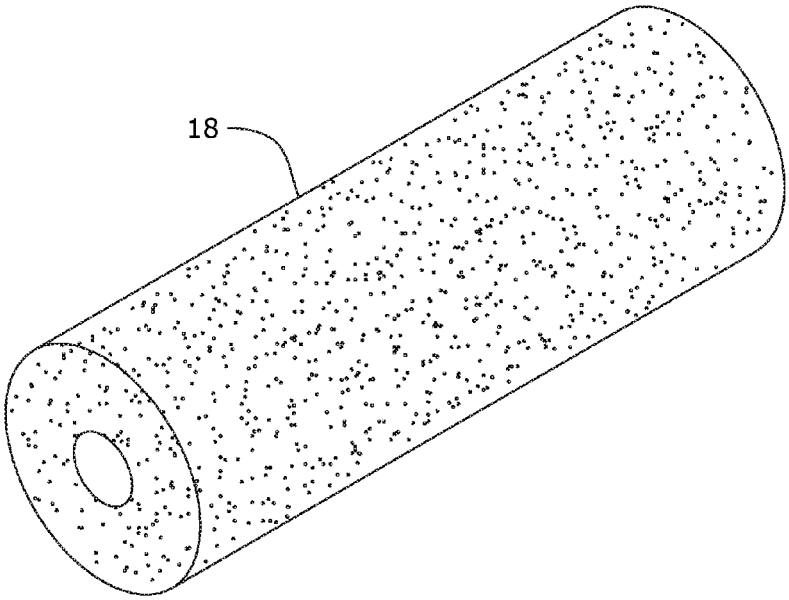
FIG. 3 is a perspective view of the filler material of FIG. 2.
Figure 4:
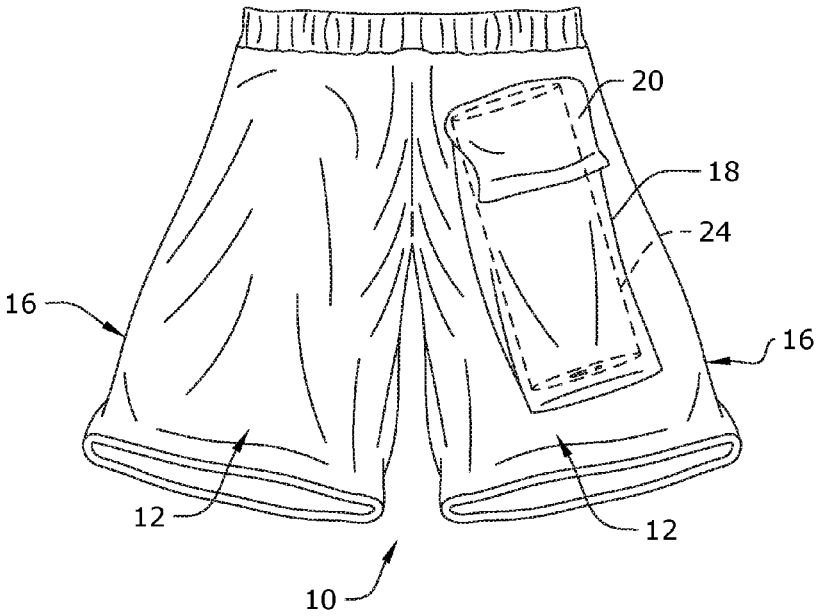
FIG. 4 is a front view of a sleep apnea sleeping aid according to another exemplary embodiment of the present invention.
Figure 5:
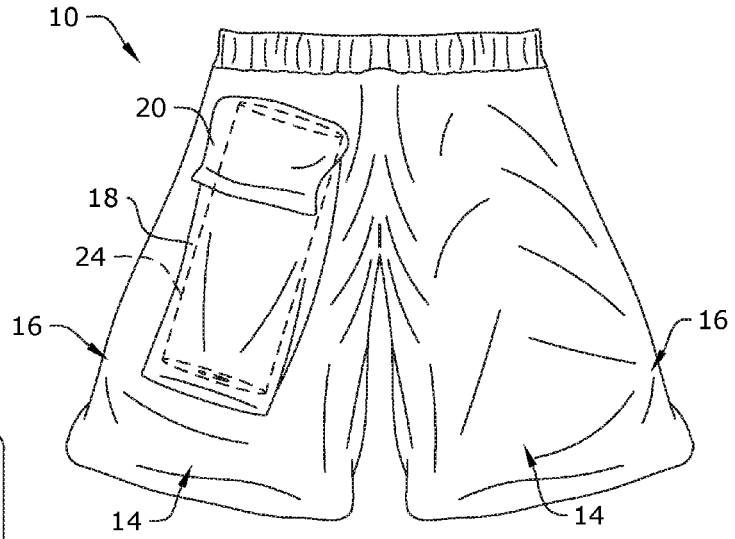
FIG. 5 is a back view of the sleep apnea sleeping aid of FIG. 4.
Figure 6:
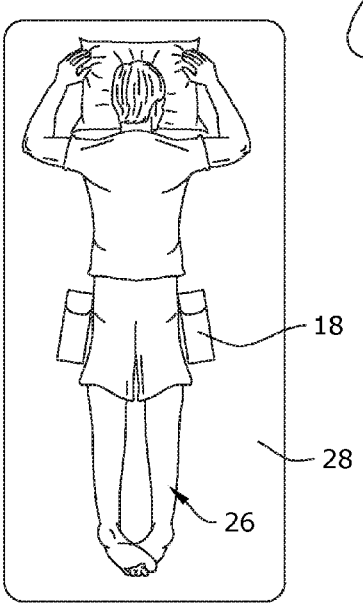
FIG. 6 is a top view exemplifying use of the sleep apnea sleeping aid of FIG. 1, showing the user sleeping on their stomach.
Figure 7:
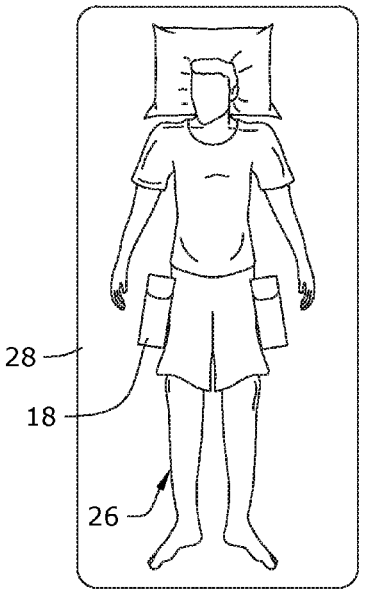
FIG. 7 is a top view exemplifying use of the sleep apnea sleeping aid of FIG. 1, showing the user sleeping on their back.
Figure 8:
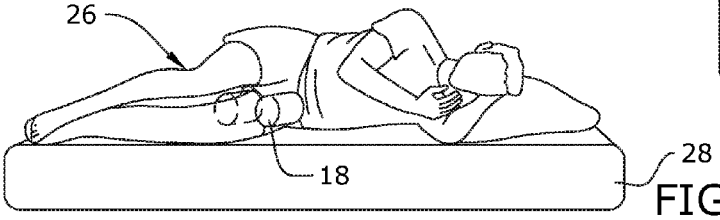
FIG. 8 is a side view exemplifying use of the sleep apnea sleeping aid of FIG. 4, showing the user sleeping on their side.
Figure 9:
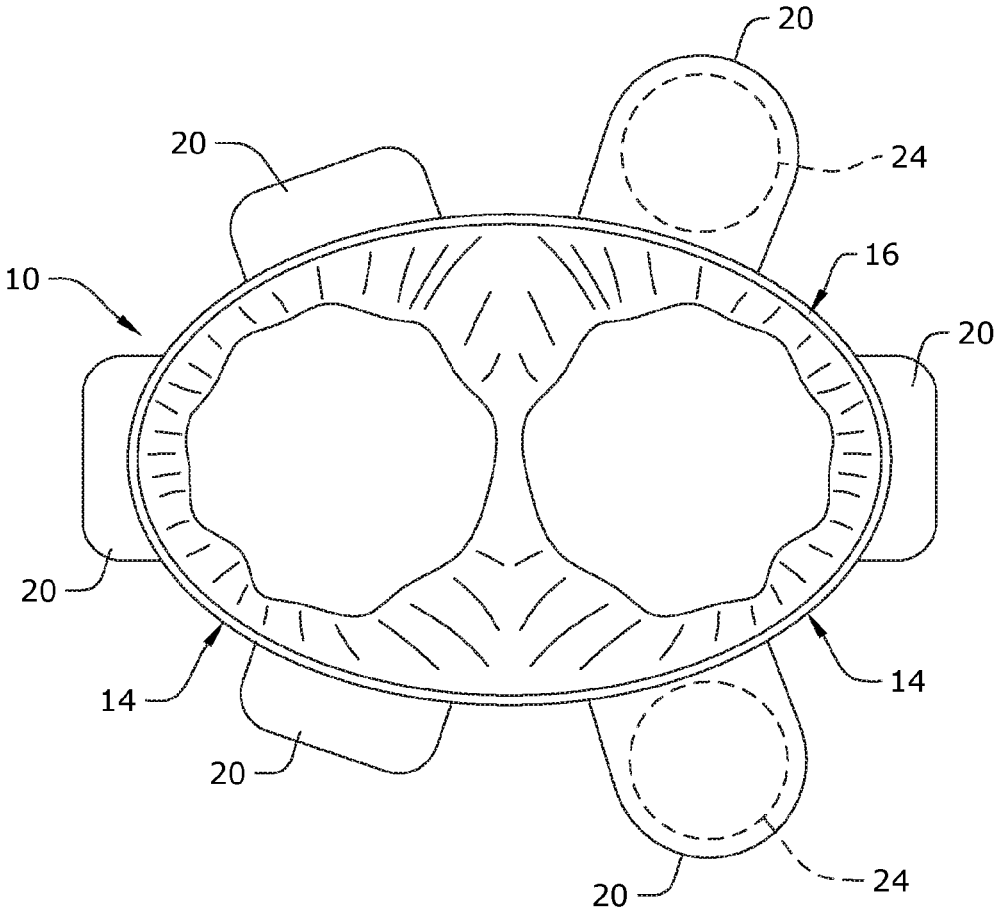
FIG. 9 is a to plan view of an exemplary embodiment of the present invention.

Referring now to FIGS. 1 through 3, motion limiting pants 10 include a front surface 12, a rear surface 14 and side surfaces 16 that form a shape of pants. The motion limiting pants 10 can be formed in various configurations, such as shorts, as shown in the Figures, or could be formed as full length pants, sweat pants, or the like. The motion limiting pants 10 may be made of a soft material, for example, fabric, cotton, fleece, or the like.

One or more pockets 24 can be formed in the motion limiting pants 10, wherein the opening of each pocket 24 may be adjacent to a waist portion of the motion limiting pants 10. The pockets 24 can include a pocket flap 20 that can close over the pocket 24 to keep a filling material 18 therein. A hook and loop fastener 22, such as Velcro®, or some other attachment mechanism, can be used to close the pocket flap 20 on the pocket 24. The filling material 18 can be a foam material, such as an expanded foam material, such as Styrofoam®, or the like. Typically, the filling material 18 is formed as a cylindrical material, typically having a diameter from about 3 to about 5 inches and a length from about 8 to about 12 inches. The pockets 24 can be sized to fully accept the size of the filling material 18.

In some embodiments, the motion limiting pants 10 can be designed for a specific purpose, such as to keep a person off his or her back, to keep a person off his or her stomach, to keep a person sleeping on his or her side, or the like. In these embodiments, the motion limiting pants 10 can include one or more pockets 24. For example, to keep a person off his or her back, the motion limiting pants 10 can include two pockets 24 on the rear side 14 of the motion limiting pants 10. If a user 26 tries to roll over on his or her backs, the filling material 18 would create a resistance against the sleeping surface 28, preventing the user from turning on his or her backs. As a second example, to keep a person off his or her stomach, the motion limiting pants 10 can include two pockets on the front side 12 of the motion limiting pants 10. As a third example, to keep a person off his or her sides, the motion limiting pants 10 can include two pockets on the sides 16 of the motion limiting pants 10. Specifically, a pocket 24 may be disposed on an outward-facing portion of at least one (or both) of the two opposing side surfaces 16, wherein each pocket 24 is defined by a boundary that is inward from a periphery of its respective side surface 16, as illustrated in FIGS. 1 and 2. As a fourth example, to keep a person only on his or her sides, the motion limiting pants 10 can include four pockets on the front and rear sides of each leg of the motion limiting pants 10.

In some embodiments, the motion limiting pants 10 can be designed with up to six pockets, two on the front side 12, two on the rear side 14 and one on each side 16. In this configuration, the user can place filling material 18 into the desired pockets to get the desired effect.

Unlike conventional products that can jolt the sleeper back on his or her side or stomach, for example, the motion limiting pants of the present invention does not allow body motion to get started and, since the sleeper never begins movement to another undesirable position, he or she does not have to be jolted back into the proper position.

The motion limiting pants 10 of the present invention can be made of various materials. In some embodiments, the motion limiting pants 10 can be made from a close-fitting material that may prevent the material from being twisted or turned relative to the user's body if he or she tries to turn during sleep.

The pockets 24 may be made of a soft material. In one embodiment, the pockets 24 may be made of the same material of the motion limiting pants 10. In another embodiment, the pockets 24 may be made of a different material from the motion limiting pants 10.

The motion-limiting pants 10 may be used in various medical fields, for example, in pediatrics for passive restraints of small children, or in emergency rooms to hold gravely wounded patients. The motion limiting pants 10 can be used in surgical procedures, for ambulance transportation, for airline passengers for overnight sleeping platforms, or the like.

It should be understood, of course, that the foregoing relates to exemplary embodiments of the invention and that modifications may be made without departing from the spirit and scope of the invention as set forth in the following claims.

What is claimed is:

1. Motion limiting pants, comprising:

a pair of pants comprising:

a waist portion designed to extend around a waist of a wearer;

two leg portions, each leg portion attached along, and dependent from, approximately separate halves of the waist portion, wherein each leg portion provides a front thigh surface, a rear thigh surface, and a side thigh surface; and six pockets, one of the six pockets disposed on each of the front, rear and side thigh surfaces of both of the two leg portions; and two filling cylinders each filling cylinder sized to substantially fill one of the six pockets.

2. The motion limiting pants of claim 1, wherein the pants are shorts.

3. The motion limiting pants of claim 1, wherein:

the front, rear thigh surface, and side thigh surfaces are adapted to extend over the front, rear and side thigh of the wearer.

4. The motion limiting pants of claim 1, further comprising:

a flap attached along an opening of each pocket.

5. The motion limiting pants of claim 1, wherein each filling cylinder is an expanded foam material.

6. The motion limiting pants of claim 1, wherein each filling cylinder extends along a longitudinal axis for 8 to 12 inches.

7. The motion limiting pants of claim 1, wherein each filling cylinder has a diameter of 3 to 5 inches.

8. The motion limiting pants of claim 7, wherein each filling cylinder extends along a longitudinal axis for 8 to 12 inches.

9. The motion limiting pants of claim 1, wherein each opening is adjacent to the waist portion.

* * * * *